US007467571B2

(12) United States Patent
Heath

(10) Patent No.: US 7,467,571 B2
(45) **Date of Patent: *Dec. 23, 2008**

(54) APPARATUS AND METHOD FOR OPENING LOCKED DOORS

(76) Inventor: Bernard Heath, 11240 Ocalla Dr., Warren, MI (US) 48089

( * ) Notice: Subject to any disclaimer, the term of this patent is extended or adjusted under 35 U.S.C. 154(b) by 1 day.

This patent is subject to a terminal disclaimer.

(21) Appl. No.: 11/776,886

(22) Filed: Jul. 12, 2007

(65) Prior Publication Data

US 2007/0256522 A1 Nov. 8, 2007

Related U.S. Application Data

(63) Continuation-in-part of application No. 11/483,449, filed on Jul. 10, 2006, now Pat. No. 7,255,023.

(60) Provisional application No. 60/794,687, filed on Apr. 25, 2006.

(51) Int. Cl.

| | |
|---|---|
| ***E05B 19/20*** | (2006.01) |
| ***B25B 33/00*** | (2006.01) |
| ***B25B 27/00*** | (2006.01) |

(52) U.S. Cl. ..... 81/15.9; 81/64; 81/488

(58) Field of Classification Search ..... 81/15.9, 81/488, 64, 3.4; 70/465; 294/19.1
See application file for complete search history.

(56) References Cited

U.S. PATENT DOCUMENTS

| | | | | |
|---|---|---|---|---|
| 4,144,778 | A | 3/1979 | Waring | |
| 4,608,886 | A * | 9/1986 | Bolton | 81/15.9 |
| 4,876,927 | A | 10/1989 | Mullen | |
| 5,123,307 | A | 6/1992 | Dyer | |
| 5,540,121 | A | 7/1996 | Helmers | |
| 5,642,648 | A | 7/1997 | Wendt et al. | |
| 6,260,455 | B1 | 7/2001 | Ferguson | |
| 6,360,637 | B1 | 3/2002 | Weinraub | |
| 6,640,667 | B1 | 11/2003 | Pomerantz | |
| 7,004,051 | B1 | 2/2006 | Orner | |
| 7,255,023 | B1 * | 8/2007 | Heath | 81/15.9 |

* cited by examiner

*Primary Examiner*—Hadi Shaker
(74) *Attorney, Agent, or Firm*—Christopher P. Maiorana, PC; Robert M. Miller

(57) ABSTRACT

An apparatus including an elongated rod adapted for sliding under a bottom of a locked door. The elongated rod includes a main section, a curved section, a handle end and an actuator end. The handle end, the curved section and the actuator end extend away from the main section in the same direction such that the handle end, the curve section, the main section, and the actuator end define a plane. The elongated rod is separable into a handle section, an actuator section and a center section.

19 Claims, 9 Drawing Sheets

APPARATUS AND METHOD FOR OPENING LOCKED DOORS

This application is a Continuation-in-Part of U.S. non-provisional application Ser. No. 11/483,449, filed Jul. 10, 2006, now U.S. Pat. No. 7,255,023 which claims the benefit of U.S. Provisional Application No. 60/794,687, filed Apr. 25, 2006, both of which are hereby incorporated by reference in their entirety.

FIELD OF THE INVENTION

The present invention relates to locksmithing services generally and, more particularly, to an apparatus and/or method for opening locked doors.

BACKGROUND OF THE INVENTION

A person can find themselves locked out of their home or office and unable to enter. For example, keys can be locked inside, a key can be broken off in the lock or the keyway of the lock can be glued through vandalism. Police may need to gain access through a locked door in order to help in an emergency or prevent a crime. Locksmiths can drill a hole into the lock case to release the locking mechanism or drill out the cylinder. However, drilling a hole in a lock case to release the locking mechanism causes damage to the unit and often requires replacement of the lock. Similarly, drilling out the cylinder requires inserting and re-pinning a new cylinder. Another method for pin and tumbler locks is to use a pick set to pick the lock. However, pick sets are illegal in most states, except when used by registered locksmiths. High security locks can be designed to prevent picking.

It would be desirable to have an apparatus and/or method for opening locked doors without causing damage to the door or to the lock and without the time consuming, or futile, process of picking the lock.

SUMMARY OF THE INVENTION

The present invention concerns an apparatus including an elongated rod adapted for sliding under a bottom of a locked door. The elongated rod includes a main section, a curved section, a handle end and an actuator end. The handle end, the curved section and the actuator end extend away from the main section in the same direction such that the handle end, the curve section, the main section, and the actuator end define a plane. The elongated rod is separable into a handle section, an actuator section and a center section.

The objects, features and advantages of the present invention include providing an apparatus and/or method for opening locked doors that may (i) open knob and/or lever type lock sets, (ii) open thumb turn deadbolts, (iii) open flush mounted panic bar type lock sets, (iv) open locked doors without causing damage to the lock and/or door, (v) operate on doors with limited space, (vi) wrap a material around a knob to maximize knob rotation, (vii) provide one-handed operation and/or (viii) be simple to operate.

BRIEF DESCRIPTION OF THE DRAWINGS

These and other objects, features and advantages of the present invention will be apparent from the following detailed description and the appended claims and drawings in which:

DETAILED DESCRIPTION OF THE PREFERRED EMBODIMENTS

The present invention generally provides apparatus for opening locked doors by either turning an inside knob or applying pressure to a panic bar type latch of the locked door. The present invention further provides a method for using the apparatus for opening locked doors. The present invention generally provides an apparatus that may open lock doors having either a knob type, a lever type or a panic bar type handle. The present invention may further provide a set of tools (or kit) comprising a set of parts that may be assembled to form a variety of tools for opening doors having (i) a knob type, (ii) a lever type handle and/or (iii) a thumb turn knob.

Figure 1:
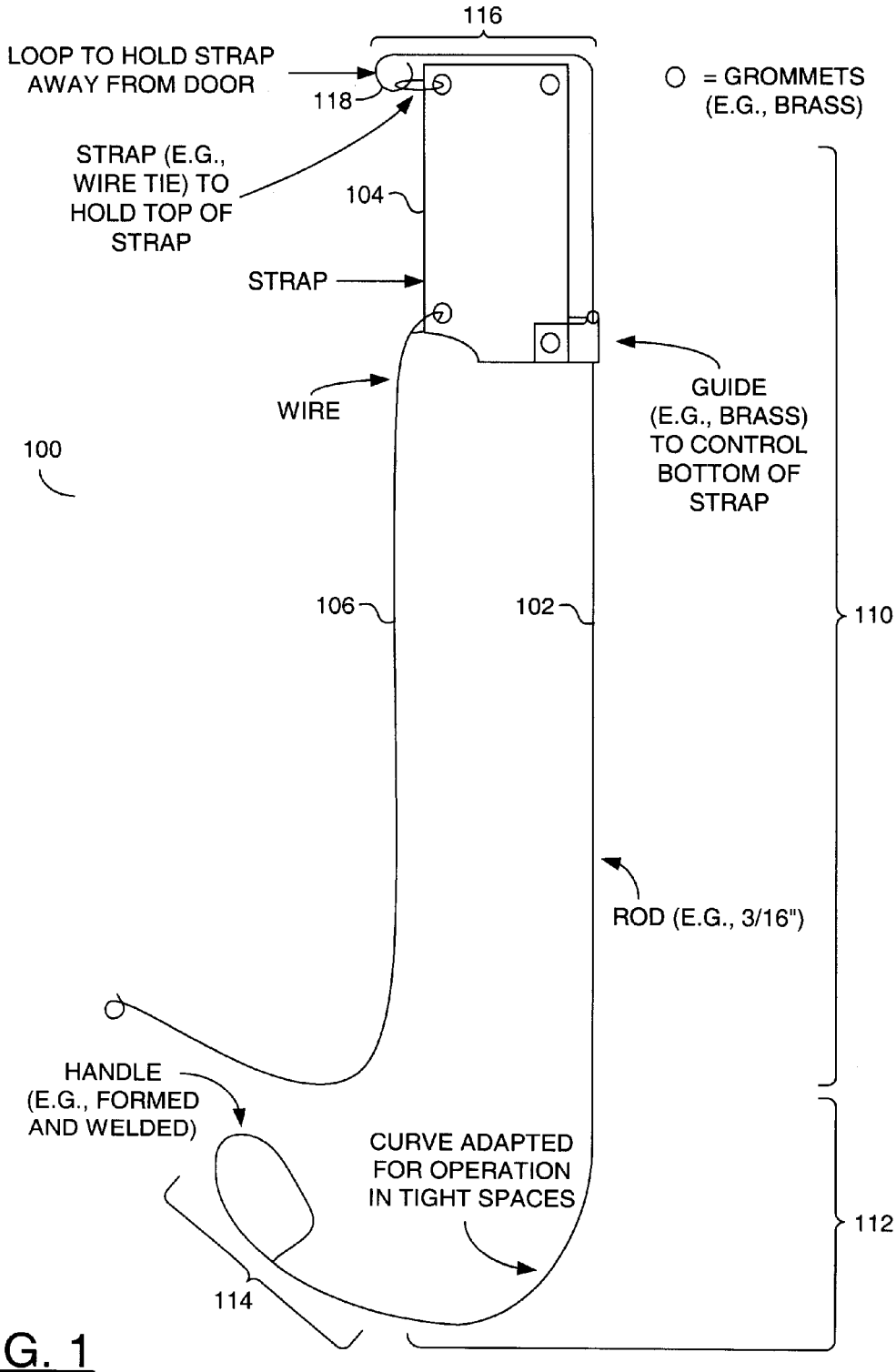
FIG. 1 is a diagram illustrating a tool in accordance with an embodiment of the present invention.

Referring to FIG. 1, a diagram is shown illustrating a tool 100 in accordance with an embodiment of the present invention. The tool 100 may comprise an elongated rod 102, a strap 104 and a pullcord 106. In one example, the elongated rod 102 may be formed from three-sixteenth inch steel rod stock. However, other sizes and materials may be used accordingly to meet the design criteria of a particular implementation. In one example, the elongated rod 102 may be powder coated for aesthetics. The elongated rod 102 generally has an overall length greater than a vertical distance between a bottom of the locked door and the door opening mechanism (e.g., knob, lever, etc.).

The elongated rod 102 may be adapted to be inserted under a locked door and raised up to make contact with the inside knob of the door allowing rotation of the knob from the outside of the door to open the locked door. A more detailed description of a method for using the tool 100 can be found in the co-pending application U.S. Ser. No. 11/483,449, filed Jul. 10, 2006, which is herein incorporated by reference in its entirety.

The elongated rod 102 generally includes a main section 110, a curved section 112, a handle end 114 and an actuator end 116. The handle end 114 may be formed by bending the rod material to form a loop and, for example, welding the loop closed. The handle end 114 is generally disposed at one end of the curved section 112. A second end of the curved section 112 connects to a first end of the main section 110. A second end of the main section 110 generally transitions into the actuator end 116. In one example, the actuator end 116 of the rod may be formed by bending a portion of the rod material perpendicular to the main section 110 and forming a loop 118 at the end of the perpendicular portion.

The strap 104 may be attached to the main section 110 and the actuator end 116 of the elongated rod. In one example, the strap 104 may be implemented using a flexible material having a high coefficient of friction (e.g., a textured rubber material, etc.). For example, the strap 104 may be formed using one-sixteenth inch red textured rubber gasket material available through a hardware store. However, any material that may provide a relatively high-friction surface and limited deformation when pressed against an object may be used.

The strap 104 may be implemented as a generally rectangular piece of material. In one example, the strap 104 may have one corner removed. In one example, the strap 104 may include four attachment locations (or points). In one example, the attachment locations may be formed with grommets inserted through the material. In one example, the grommets may be metal (e.g., aluminum, brass, etc.). However, other materials may be used accordingly to meet the design criteria of a particular implementation.

The strap 104 may have a first upper corner, a second upper corner, a first lower corner and a second lower corner. In one example, a distance between the first upper corner and the first lower corner may be shorter than a distance between the second upper corner and the second lower corner. The first upper corner of the strap 104 may be attached to a loop portion 118 of the actuator end 116 using a first connection device. The first connection device generally provides a rigid connection between the strap 104 and the actuator end 116. In one example, the first connection device may be implemented with a nylon wire tie. However, other connection devices may be implemented accordingly to meet the design criteria of a particular implementation.

The second lower corner of the strap 104 may be connected to the main section 110 using a second connection device. The second connection device generally provides a rigid connection between the strap 104 and the main section 110. In one example, the second connection device may comprise a metal (e.g., brass, aluminum, steel, etc.) or plastic (e.g., nylon, etc.) guide strap. The guide strap may be adapted to slide along the main section 110 of the elongated rod 102.

The pullcord 106 may be attached to the first lower corner of the strap 104. The pullcord 106 may be implemented using wire, string, cord, twine, or other string-like material. The attachment point in the first lower corner of the strap 104 is generally vertically displaced from a line drawn perpendicularly to the main section 110 of the elongated rod 102 and through the attachment point in the second lower corner. Therefore, the point of attachment of the pull cord to the first lower corner is at a position higher than the point of attachment of the second lower corner of the strap 104 to the main section 110 of the elongated rod 102.

The second upper corner of the strap 104 may be, in one example, left disconnected from the actuator end 116 of the elongated rod 102. In another example, the second upper corner of the strap 104 may be connected via a third connection device to either the actuator end 116 or the main section 110 of the elongated rod 102.

Figure 2:
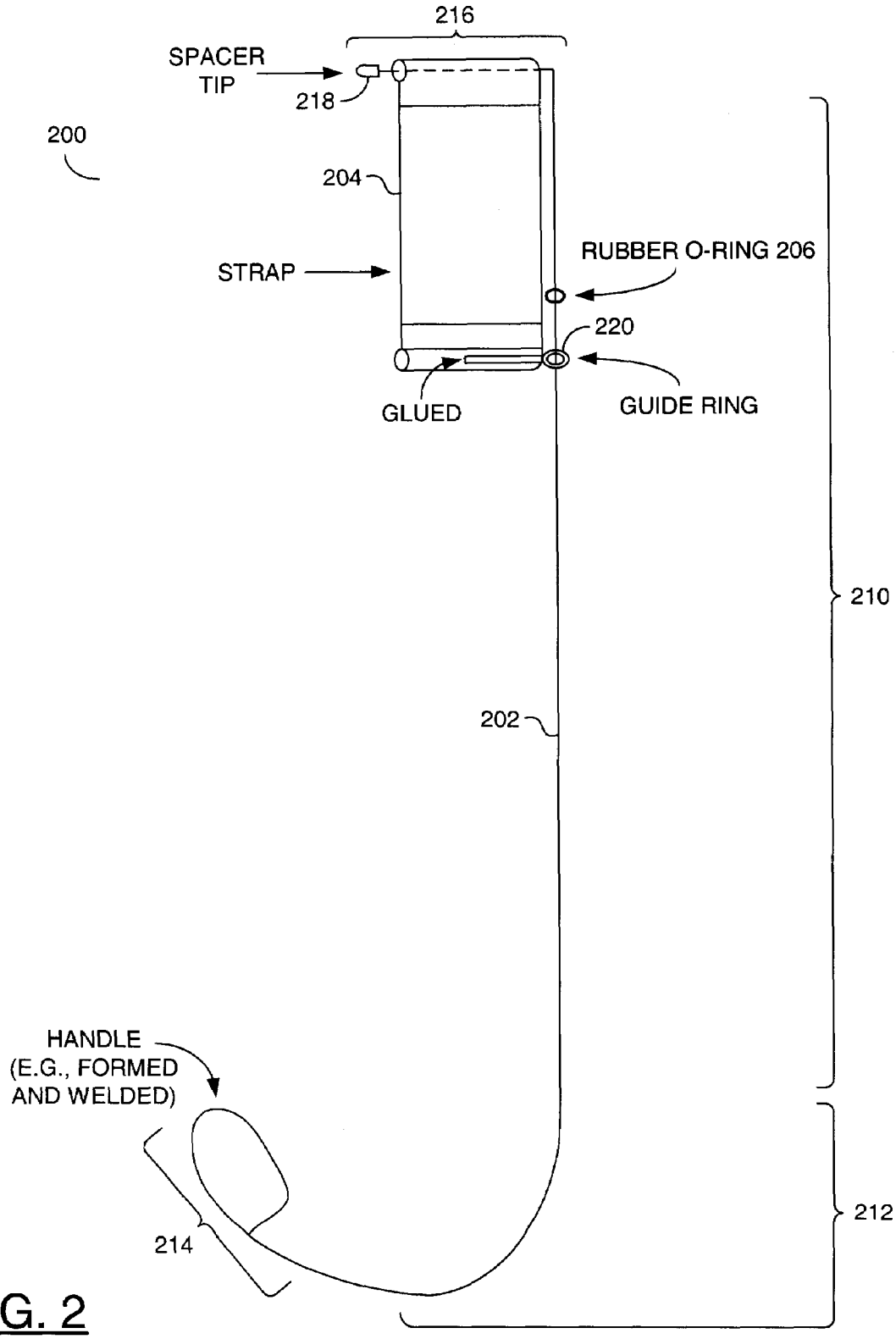
FIG. 2 is a diagram illustrating an alternative embodiment of the present invention.

Referring to FIG. 2, a diagram of a tool 200 is shown illustrating another embodiment of the present invention. The tool 200 may be used similarly to the tool 100 except that the tool 200 may allow one-handed operation. For example, the tool 200 may be operated similarly to the tool 100 while eliminating the pullcord 106.

The tool 200 may comprise an elongated rod 202, a strap 204 and a stopper device 206. In one example, the elongated rod 202 may be formed from three-sixteenth inch steel rod stock. However, other sizes and materials may be used accordingly to meet the design criteria of a particular implementation. The elongated rod 202 generally has an overall length greater than a vertical distance between a bottom of the locked door and the door opening mechanism (e.g., knob, lever, etc.).

The elongated rod 202 may be adapted to be inserted under a locked door and raised up to make contact with the inside knob of the door allowing rotation of the knob from the outside of the door to open the locked door. The elongated rod 202 generally includes a main section 210, a curved section 212, a handle end 214 and an actuator end 216. The handle end 214 may be formed by bending the rod material to form a loop and, for example, welding the loop closed. The handle end 214 is generally disposed at one end of the curved section 212. A second end of the curved section 212 connects to a first end of the main section 210. A second end of the main section 210 generally transitions into the actuator end 216. In one example, the actuator end 216 of the rod may be formed by bending a portion of the rod material perpendicular to the main section 210 and attaching a tip 218 at the end of the perpendicular portion. The tip 218 generally comprises a material for protecting a finish of a door. In one example, the tip 218 may be implemented by placing a soft plastic bolt cover over the end of the rod material forming the actuator end 216. In another example, the tip 218 may be formed using a plastic material (e.g., nylon, Teflon, etc.) and attached (e.g., threaded on, press fitted, etc.) to the actuator end 216.

The strap 204 may be attached to the main section 210 and the actuator end 216 of the elongated rod 202. In one example, the strap 204 may be implemented using a flexible material having a high coefficient of friction (e.g., a textured rubber material, etc.). For example, the strap 204 may be formed using one-sixteenth inch red textured rubber gasket material. However, any material that may provide a relatively high-friction surface and limited deformation when pressed against an object may be used.

The strap 204 may be implemented as a generally rectangular piece of material. In one example, a top end of the strap 204 may be wrapped around the actuator end 216 and fastened back to itself. In one example, an adhesive product (e.g., Super Bonder® 420 Instant Adhesive from Henkel Loctite Corporation, Rocky Hill, Conn.) designed to bond (weld, glue, fuse, etc.) the particular material of the strap 204 may be used to form the top end of the strap 104 into a sleeve that fits over the actuator end 216.

A lower end of the strap 204 may be connected on one side to the main section 210 using a connection device 220. In one example, the connection device may be metal (e.g., brass, aluminum, steel, etc.) or plastic (e.g., nylon, etc.). The connection device 220 may comprise a guide strap (or ring) adapted to slide along the main section 210 of the elongated rod 202. In one example, the connection device 220 may be implemented using a nylon wire tie. In one example, the lower end of the strap 204 may be glued similarly to the top end to form a sleeve via which the connection device 220 connects to the strap 204.

The stopper device 206 may be attached to the main section 210 of the elongated rod 202 between the actuator end 216 and the connection device 220. The stopper device 206 may be implemented, in one example, as a rubber o-ring. In one example, the o-ring may have an inner diameter approximately equal to or less than a diameter of the elongated rod 202. In general, the stopper device 206 is configured such that the stopper device 206 may be easily positioned along the main section 210 while providing substantial resistance to (e.g., stopping) movement of the connection device 220 past the position of the stopper device 206, along the main section 210, during operation of the tool 200.

The tool 200 is generally slid under a locked door and lifted into a vertical position. When the tool 200 is in a vertical position with the tip 218 against the back of the locked door, the tool 200 is generally rotated such that the strap 204 is brought down on the door opening mechanism (e.g., knob, lever, etc.). As the tool 200 is brought down on the door opening mechanism, the strap 204 wraps on the door opening mechanism and the connection device 220 slides along the main section 210 until stopped by the stopper device 206. When the connection device 220 is stopped by the stopper device 206, resistance may be felt to further lowering of the tool 200 onto the door opening mechanism. When resistance is felt to further lowering of the tool 200, the handle end 214 of the tool 200 may be moved toward the hinge side of the door to rotated the door opening mechanism and open the locked door. In general, the operation of opening the locked door with the tool 200 may be performed with one hand.

In one example, the strap 204 may be implemented having a length ranging from about twelve inches to about eighteen inches and a width ranging from about two inches to about four inches. The stopper device 206 is generally initially positioned about two inches above a lowest position of the connection device 220 along the main section 210. However, the initial position of the stopper device 206 may be varied to vary the amount of the strap 204 that wraps on the door opening mechanism. Increasing the initial distance between the stopper device 206 and the connection device 220 generally increases the amount of the strap 204 that wraps on the door opening mechanism. Increasing the amount of the strap 204 that wraps on the door opening mechanism generally increases the force applied by the tool 200 to rotate the door opening mechanism.

Figure 3:
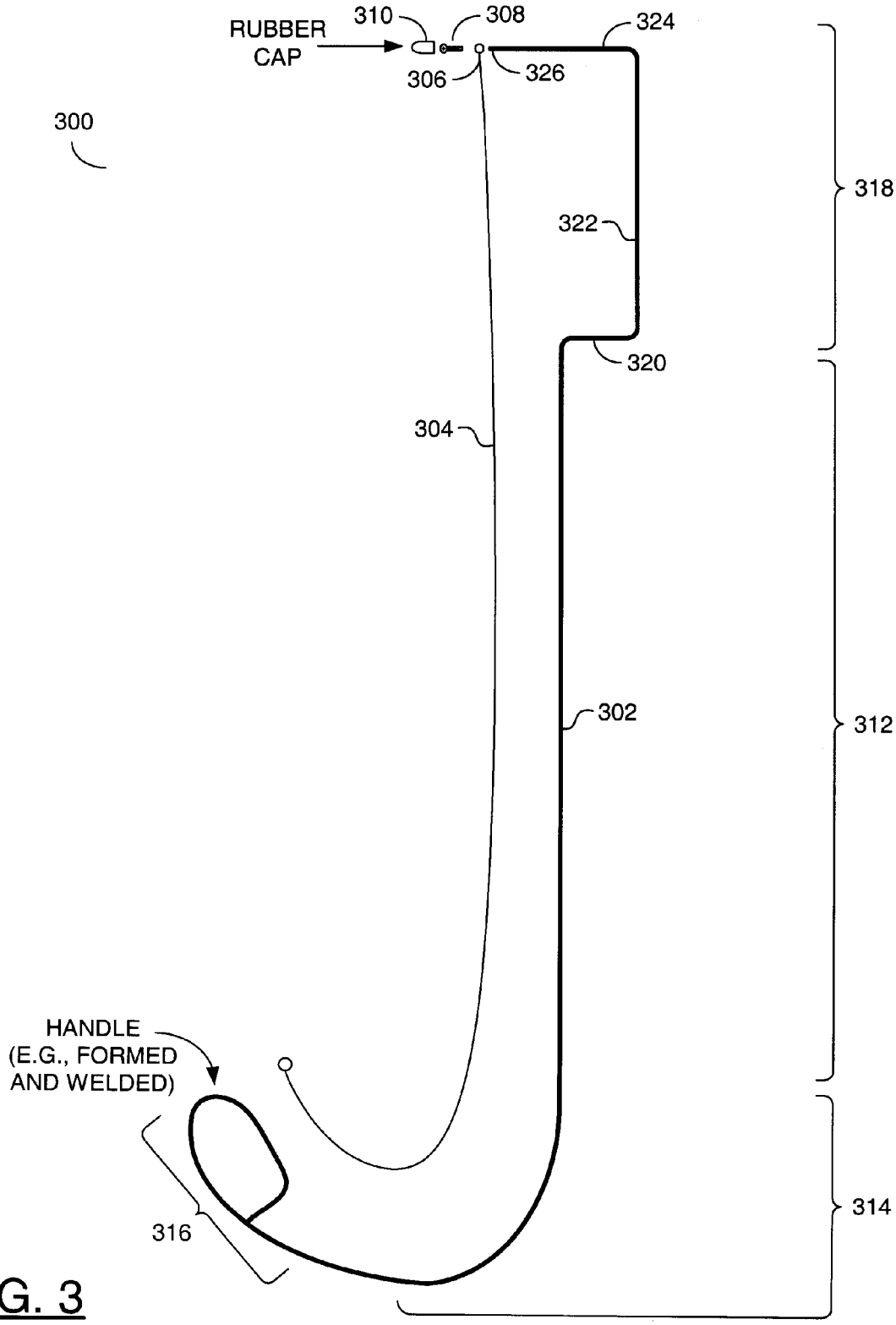
FIG. 3 is a diagram illustrating a tool in accordance with another embodiment of the present invention adapted for opening lever handle type locksets.

Referring to FIG. 3, a diagram is shown illustrating a tool 300 in accordance with another embodiment of the present invention. The tool 300 may be used similarly to the tools 100 and 200 except that the tool 300 may be adapted for operation on lever type handles. The tool 300 may comprise an elongated rod 302. In one example, the elongated rod 302 may be formed from three-sixteenth inch steel rod stock. However, other sizes and materials may be used accordingly to meet the design criteria of a particular implementation. The elongated rod 302 generally has an overall length greater than a vertical distance between a bottom of the locked door and the door opening mechanism (e.g., knob, lever, etc.).

The elongated rod 302 may be adapted to be inserted under a locked door and raised up to make contact with the inside lever handle of the door allowing rotation of the lever handle from the outside of the door to open the locked door. In one example, the tool 300 may be operated using an optional pullcord 304. In one example, the pull cord 304 may be attached to the tool 300 by an eyelet 306 (e.g., attached to the pull cord 304 by crimping, brazing etc.) and a fastener 308 (e.g., a threaded machine screw, etc.). A protective tip 310 (e.g., a rubber cap, plastic cap, etc.) may be placed over the fastener 308 to protect a back surface of a door on which the tool 300 is used.

The elongated rod 302 generally includes a main section 312, a curved section 314, a handle end 316 and an actuator end 318. The handle end 316 may be formed by bending the rod material to form a loop and, for example, welding the loop closed. The handle end 316 is generally disposed at one end of the curved section 314. A second end of the curved section 314 connects to a first end of the main section 312. A second end of the main section 312 generally transitions into the actuator end 318.

In one example, the actuator end 318 of the rod may be formed by bending the rod material at substantially ninety degree angles to form a portion 320, a portion 322, and a portion 324. The portion 320 of the rod material is bent substantially perpendicular to the main section 312 and directed in a direction opposite the handle end 316. The portion 322 of the rod material is bent substantially perpendicular to the portion 320 (substantially parallel to the main section 312) and is directed in a direction opposite the handle end 316. The portion 324 of the rod material is bent substantially perpendicular to the portion 322 and directed in a direction toward the handle end 316. An end 326 of the portion 324 may be drilled and tapped to receive the threaded fastener 308. The main section 312, the curved section 314, the handle end 316 and the actuator end 318, including the portions 320, 322 and 324 generally lie in substantially the same plane.

The tip 310 generally comprises a material for protecting a finish of a door. In one example, the tip 310 may be implemented by placing a soft plastic bolt cover over the end 326 of the portion 324 of the actuator end 318. In another example, the tip 310 may be formed using a plastic material (e.g., nylon, Teflon, etc.) and attached (e.g., threaded on, press fitted, etc.) to the portion 324.

The tool 300 is generally slid under a locked door and lifted into a vertical position. When the tool 300 is in a vertical position with the tip 310 against the back of the locked door, the tool 300 is generally rotated such that the portion 324 is brought down on the door opening mechanism (e.g., lever, etc.). With the tool 300 in contact with the door opening mechanism, the tool 300 may be manipulated to apply pressure on the door opening mechanism (e.g., by rotating the tool 300 or pulling the pull cord 304), opening the locked door. In general, the operation of opening the locked door with the tool 300 may be performed with one hand or two hands.

Figure 4:
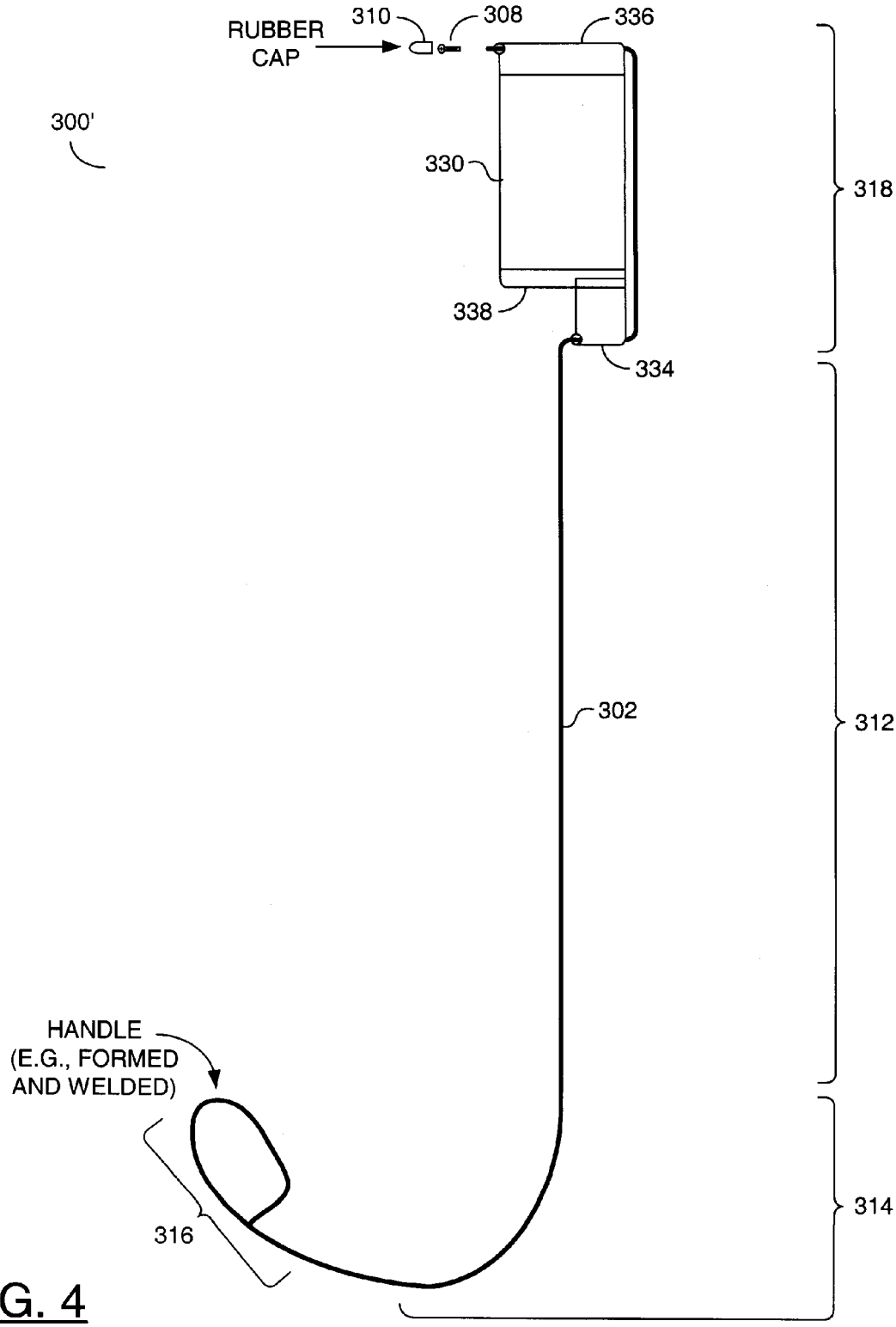
FIG. 4 is a diagram illustrating the tool of FIG. 3 adapted for opening knob type locksets.

Referring to FIG. 4, a diagram is shown illustrating a tool 300' in accordance with another embodiment of the present invention. The tool 300' may be implemented similarly to the tool 300 illustrated in FIG. 3, except the tool 300' further comprises a strap 330. The strap 330 generally adapts the tool 300 for operation on knob type handles. The strap 330 is removable from the tool 300' for operation as described above in connection with FIG. 3. The strap 330 may be attached at one end to the potion 320 and at another end to the portion 324. The strap 330 may comprise a first portion 332, a second portion 334, a third portion 336 and a fourth portion 338. The portion 332 may be implemented with shelf lining material. The portion 334 may be implemented with an elastic material. The portions 336 and 338 may further comprise leather or vinyl material in addition to the materials of the portions 332 and 334. The portion 336 may be formed by wrapping the material of the portion 332 around the tool portion 324 and stitching (or gluing) the material of the portion 332 to itself, with or without the leather or vinyl material for reinforcement. The portion 338 may be formed by wrapping the elastic material of the portion 334 around the tool portion 320 and stitching (or gluing) the material of the portion 334 to the material of the portion 332, with or without the leather or vinyl material for reinforcement.

The tool 300' may be used similarly to the tool 200 of FIG. 2. For example, the elastic portion 334 of the strap 330 generally provides an automatic resistance that may operate similarly to the stopper device 206 of the tool 200. The tool 300' is generally slid under a locked door and lifted into a vertical position. When the tool 300' is in a vertical position with the tip 310 against the back of the locked door, the tool 300' is generally rotated such that the strap 330 is brought down on the door opening mechanism (e.g., knob, lever, etc.). As the tool 300' is brought down on the door opening mechanism, the strap 330 wraps around a knob on the door opening mechanism, or applies pressure to a lever handle of the door opening mechanism, opening the locked door. In general, the operation of opening the locked door with the tool 300' may be performed with one hand or two hands.

Figure 5:
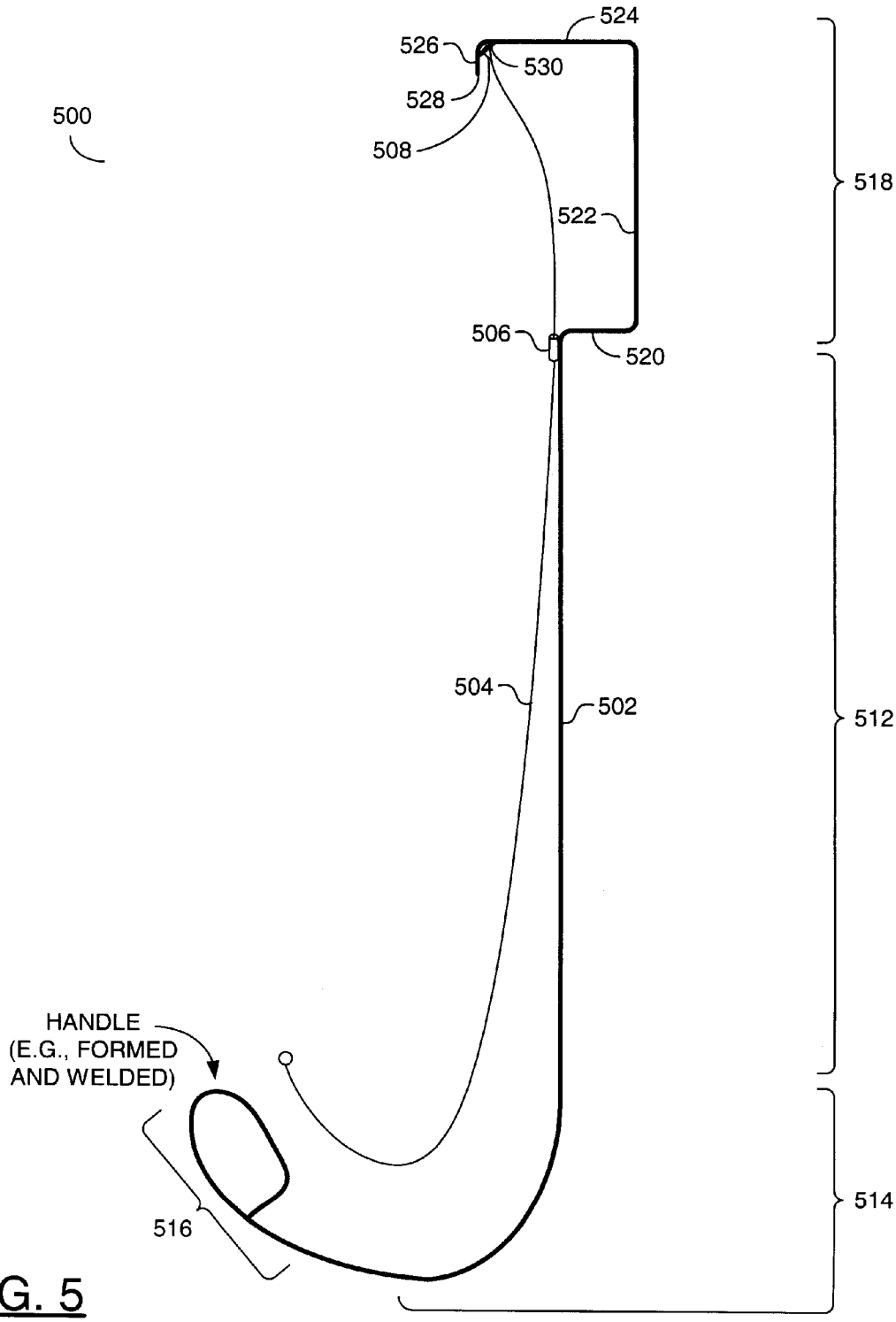
FIG. 5 is a diagram illustrating a tool in accordance with another embodiment of the present invention adapted for opening panic bar type locksets.

Referring to FIG. 5, a diagram is shown illustrating a tool 500 in accordance with another embodiment of the present invention. The tool 500 may be used similarly to the tools 100-400 except that the tool 500 may be adapted for operation on panic bar (or crash bar) type locksets.

The tool 500 may comprise an elongated rod 502, a pull cord 504 and a guide 506. The pull cord 504 passes through the guide 506. An end 508 of the pull cord 504 and the guide 506 are attached to the elongated rod 502. In one example, the elongated rod 502 may be formed from three-sixteenth inch steel rod stock. However, other sizes and materials may be used accordingly to meet the design criteria of a particular implementation. The elongated rod 502 generally has an overall length greater than a vertical distance between a bottom of the locked door and a top of the door opening mechanism (e.g., panic bar, etc.).

The elongated rod 502 generally includes a main section 512, a curved section 514, a handle end 516 and an actuator end 518. The handle end 516 may be formed by bending the rod material to form a loop and, for example, welding the loop closed. The handle end 516 is generally disposed at one end of the curved section 514. A second end of the curved section 514 connects to a first end of the main section 512. A second end of the main section 512 generally transitions into the actuator end 518.

In one example, the actuator end 518 may be formed by bending the rod material at substantially ninety degree angles to form a portion 520, a portion 522, a portion 524 and a portion 526. The portion 520 of the rod material is bent substantially perpendicular to the main section 512 and directed in a direction opposite the handle end 516. The portion 522 of the rod material is bent substantially perpendicular to the portion 520 (substantially parallel to the main section 512) and is directed in a direction opposite the handle end 516. The portion 524 of the rod material is bent substantially perpendicular to the portion 522 and directed in a direction toward the handle end 516. The portion 526 of the rod material is bent substantially perpendicular to the portion 524 and directed toward the handle end 516. An end 528 of the portion 526 may be wedge (or chisel) shaped.

A brace 530 may be coupled to the portion 524 and the portion 526. In one example, the brace may comprise the same rod material as used to form the elongated rod 502. In one example, the portion 524, the portion 526 and the brace 530 may enclose a triangular space. In another example, the portion 524, the portion 526 and the brace 530 may enclose a circular space. The end 508 of the pull cord 504 may be attached to the brace 530. The main section 512, the curved section 514, the handle end 516, the actuator end 518 (including the portions 520, 522, 524 and 526) and the brace 530 generally lie in substantially the same plane.

Figure 6:
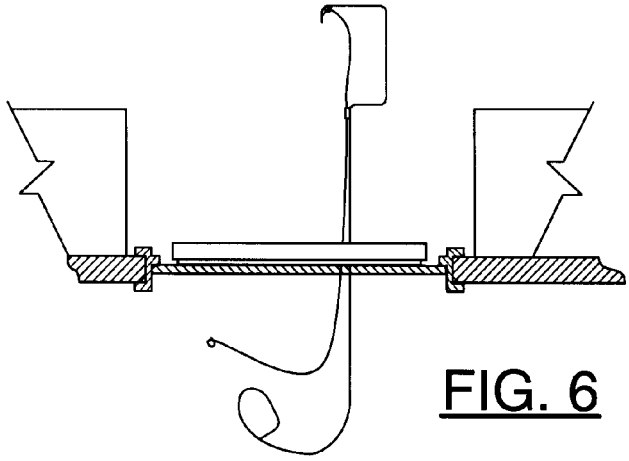
FIG. 6 is a diagram illustrating the tool of FIG. 5 under a door with a panic bar type lockset.
Figure 7:
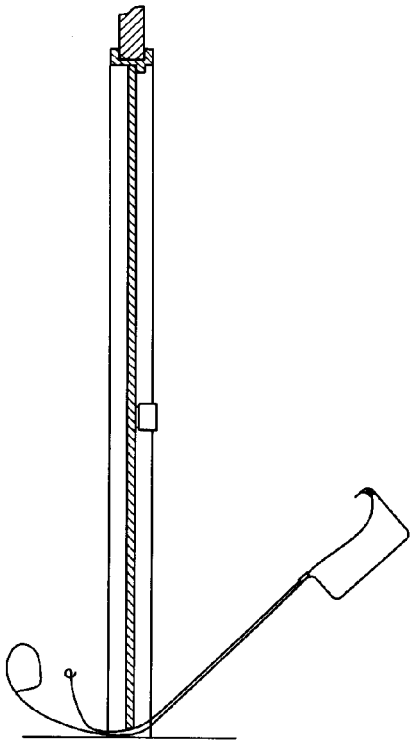
FIG. 7 is a diagram illustrating the tool of FIG. 5 being lifted toward the door.
Figure 8:
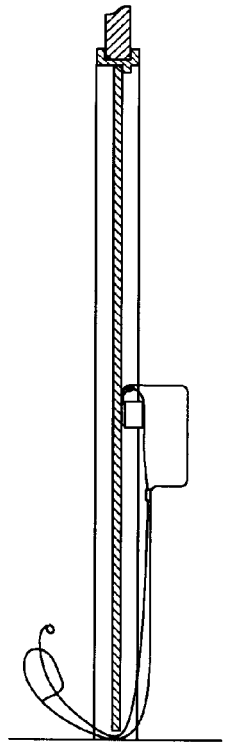
FIG. 8 is a diagram illustrating the tool of FIG. 5 lifted to a vertical position against the door and maneuvered into contact with the panic bar type lockset of the door.

The tool 500 may be adapted to be inserted under a locked door and raised up to make contact with an inside panic (or crash) bar handle of the door allowing pressure to be placed on the panic bar handle from the outside of the door to open the locked door (illustrated in more detail in FIGS. 6-8). In one example, the tool 500 may be slid under the door (e.g., as illustrated in FIG. 6) and lifted up to make contact with the back of the door (e.g., as illustrated in FIG. 7). When the back of the door is contacted, the tool 500 may be rotated to move the wedge end 528 down toward the panic bar (e.g., as illustrated in FIG. 8). When the tool 500 contacts the bar, the handle end of the tool 500 may be pulled to engage the wedge end 528 of the tool 500 between the door and the panic bar assembly. The pullcord 504 may be pulled to apply pressure to the bar, retracting the latch and opening the door.

Referring to FIGS. 6-8, diagrams are shown illustrating various points in an example operation of the tool 500. The curved section 514 of the elongated rod 502 is generally adapted to allow operation of the tool 500 on doors having limited space behind them. For example, the tool 500 may be slid under the door to a point where the actuator end 518 is completely on the rear side of the door (FIG. 6). The handle portion 516 may then be rotated up approximately 90 degrees from the floor also raising the portion 526 of the actuator end 518 (FIG. 7). The tool 500 may then be rotated upwards to bring the actuator end 518 of the elongated rod 502 into contact with the back side of the door (FIG. 8). In general, the apparatus is slid beneath a center portion of the door and raised up into position.

Figures 9, 9A:
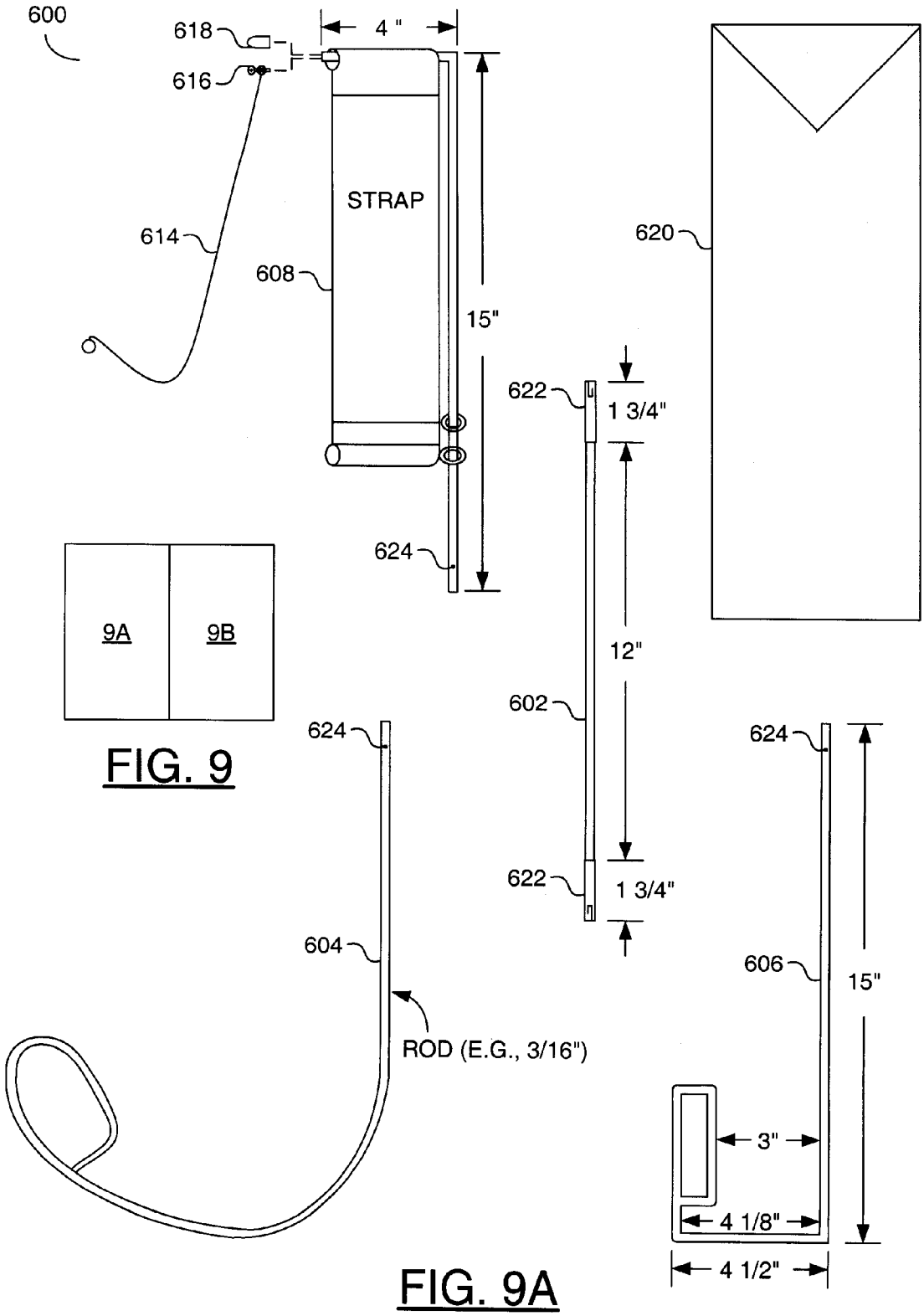
FIG. 9 is a diagram illustrating a breakdown version of the tools illustrated in FIGS. 1-5.
Figure 9B:
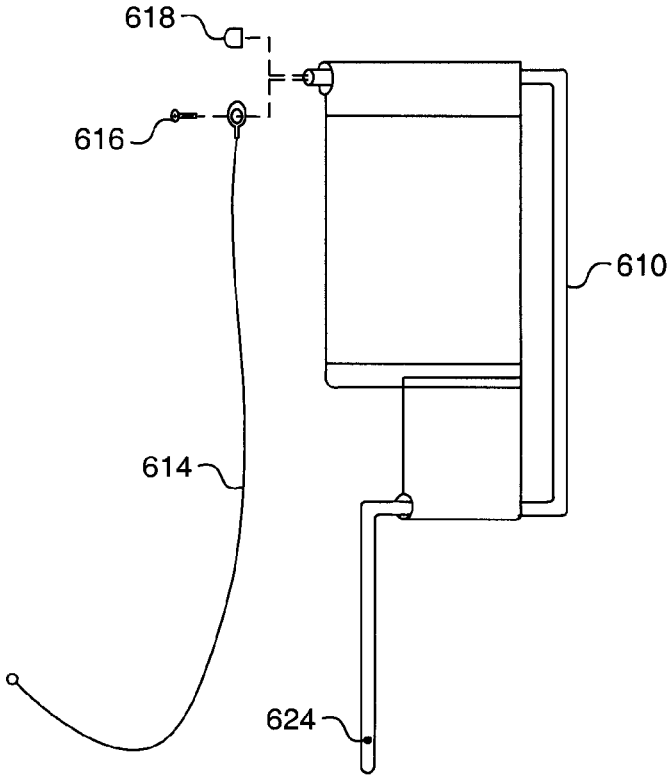
Figure 9B:
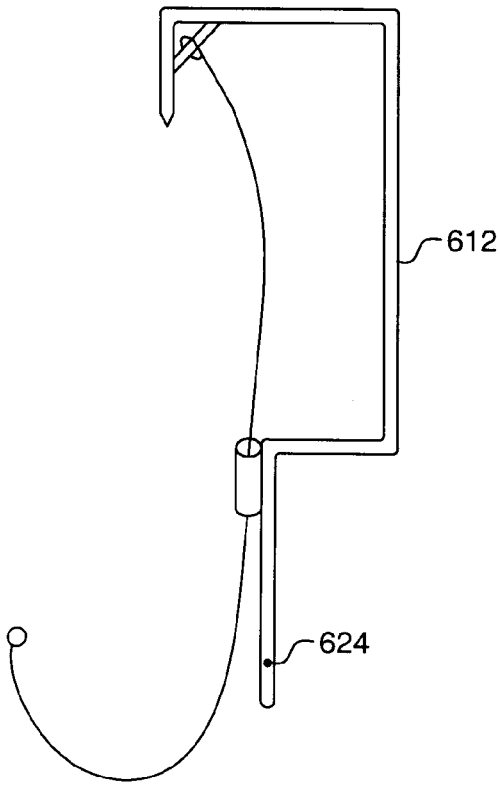

Referring to FIG. 9, a diagram is shown illustrating elements of a kit 600 containing break down versions of the tools 100, 200, 300, 300' and 500. The break down versions of the tools 100-500 generally allow for easy transportation and/or concealment. The kit 600 may comprise a center section 602, a curved handle section 604, a rectangular handle section 606, a first actuator section 608, a second actuator section 610, a third actuator section 612, a pull cord 614, a fastener 616, a protective tip 618 and a carrying pouch 620. The pouch 620 may be made with any appropriate material (e.g., duck bill cloth, vinyl, leather, etc.). In one example, the kit 600 may be implemented with fewer than all the elements illustrated.

The actuator section 608 may be implemented similarly to the actuator and strap of the tool 200 (discussed in more detail in connection with FIG. 2 above). The actuator section 610 may be implemented similarly to the actuator end 318 and strap 330 (discussed in more detail in connection with FIGS. 3 and 4 above). The actuator section 612 may be implemented similarly to the actuator end 518 with pull cord 504 and guide 506 (discussed in more detail in connection with FIG. 5 above).

In one example, the center section 602, the handle sections 604 and 606, and the actuator sections 608, 610 and 612 may be formed from three-sixteenth inch steel rod stock. However, other sizes and materials may be used accordingly to meet the design criteria of a particular implementation. The sections may be proportioned such that a tool assembled from the respective sections has an overall length greater than a vertical distance between a bottom of the locked door and the door opening mechanism (e.g., knob, lever, etc.).

In one example, the center section 602 may have a length of about fourteen and one-half inches. The handle sections 604 and 606 may have a height (or longest axis) of about fifteen inches. The handle section 606 may have a width (or shortest axis) of about four and one-half inches. The actuator sections 606, 610 and 612 may have a height (or longest axis) of about fifteen and one-half inches.

In one example, the center section 602 may comprise a pair of connectors 622; one at each end. In one example, the connectors may each be about one and three-quarter inches in length and separated by about twelve inches of the rod material of the section 602. In one example, each of the connectors may be formed from a one-quarter inch O.D. tube. Each of the connectors may have a J-channel configured to form a locking bayonet style coupling with one of the handle sections 604 and 606 or one of the actuator sections 608, 610, 612. Each of the handle sections 604 and 606 and the actuator sections 608, 610, 612 may have a guide pin 624 that may be configure to engage the J-channel locking the parts together. Each of the connectors 622 may include a spring configured to hold the pin of a handle section or actuator section in the top of the lower part of the J-channel. However, other type of couplings may be implemented accordingly to meet the design criteria of a particular implementation.

Each of the connectors 622 may be solidly connected to the center section. In one example, a hole may be drilled through the connector and rod material to allow a pin to be pressed in place locking the connector to the rod. In another example, the connector 622 may be brazed to the ends of the center section 602.

A particular tool may be assembled by pushing a rod and pin of either a handle section (604 or 606) or an actuator section (608, 610 or 612) into one of the connectors of the center section 602. While pressing the rod into the connector, the rod is turned such that the guide pin 624 follows the J-channel until the guide pin is pushed into the end of the J-channel by the internal spring of the connector 622. When the components are assembled into a tool, the tool generally operates in a similar manner to corresponding one of the tools 200-500. The tool is easily broken down by reversing the assembly process.

In one example, the handle section 606 may be configured such that the inside portion of the loop acts as a guide by contacting an outside surface of the door to be unlocked. The bottom portion of the handle section 606 may be configured to sit on the floor under the locked door when the tool is in position and ready to use.

Figure 10:
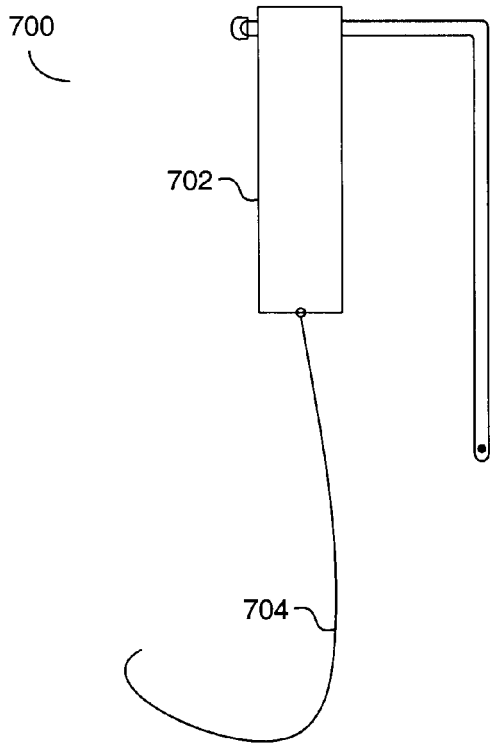
FIG. 10 is a diagram illustrating a tool for opening dead bolt type locksets with thumb turn knobs.

Referring to FIG. 10, a diagram is shown illustrating an actuator section 700 that may be included in the kit 600. The actuator section 700 may include a narrow strap 702 and a pull cord 704. The strap 702 may be formed from material similar to the straps 104, 204 and 330 described above. When a tool with the actuator section 700 contacts the back of a locked door, the tool may be leaned (or rotated) down toward the thumb turn knob of the lockset. The tool is then slid toward the hinge side of the door such that the strap wraps over the thumb turn knob. The pull cord 704 is pulled to rotate the thumb turn knob to rotate the lockset to the unlocked positioned. The dead bolt may be re-locked by reversing the above steps with the strap wrapped around the knob in the reverse direction. When the door is locked, the tool may be removed.

Figure 11:
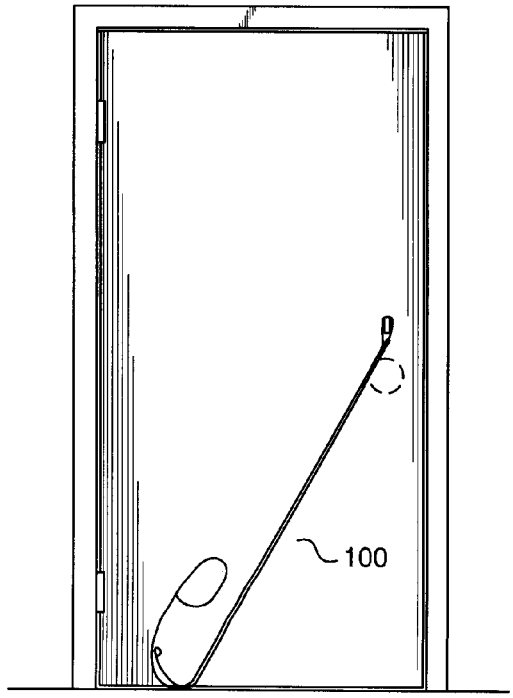
FIG. 11 is a diagram illustrating a strap of the tool of FIG. 10 wrapped on a thumb turn knob of a dead bolt lock of the door.

Referring to FIG. 11, a diagram is shown illustrating the tool 700 in use on a dead bolt lockset with a thumb turn knob.

The present invention generally provides tools that may be used to open locked doors that have damaged key cylinders and/or locks that have pick resistant cylinders. The tools implemented in accordance with the present invention may be used to open locked doors having locks that meet fire codes specifying that commercial locks open with a single turn. The tools implemented in accordance with the present invention may be adapted to slide under a locked door using a small gap between the door and the floor that may result from barrier free access specifications. The present invention may provide a kit comprising a set of tools capable of opening knob, lever and/or crash bar type doors (e.g., similar to the tools 100-500 above).

While the invention has been particularly shown and described with reference to the preferred embodiments thereof, it will be understood by those skilled in the art that various changes in form and details may be made without departing from the spirit and scope of the invention.

The invention claimed is:

1. An apparatus comprising:

an elongated rod adapted for sliding under a bottom of a locked door, said elongated rod comprising a main section, a curved section, a handle end and an actuator end, wherein the handle end, the curved section and the actuator end extend away from the main section in the same direction such that the handle end, the curve section, the main section, and the actuator end define a plane, and wherein the actuator end comprises a first portion, a second portion and a third portion, the first portion extending substantially perpendicular from the main section and directed in a direction opposite the handle end, the second portion being substantially perpendicular to the first portion, substantially parallel to the main section and directed in a direction opposite the handle end, and the third portion being substantially perpendicular to the second portion and directed in a direction toward the handle end; and a strap adapted for engagement with an opening mechanism of the locked door, wherein a first end of the strap is attached to the third portion of the actuator end and one side of a second end of the strap is coupled to the first portion of the actuator end by an elastic material.

2. The apparatus according to claim 1, wherein the third portion of the actuator end is longer than the first portion of the actuator end.

3. The apparatus according to claim 1, wherein said elongated rod is separable into a handle section, an actuator section and a center section.

4. An apparatus comprising:

an elongated rod adapted for sliding under a bottom of a locked door, said elongated rod comprising a main section, a curved section, a handle end and an actuator end, wherein the handle end, the curved section and the actuator end extend away from the main section in the same direction such that the handle end, the curve section, the main section, and the actuator end define a plane, and wherein said elongated rod is separable into a handle section, an actuator section and a center section;

a strap adapted for engagement with an opening mechanism of the locked door, wherein a first end of said strap is attached to said actuator end and a second end of said strap is attached to said main section by a first connection device adapted to slide along said main section of the elongated rod.

5. The apparatus according to claim 4, wherein said strap comprises a rectangle of textured rubber gasket material.

6. The apparatus according to claim 4, wherein said strap comprises a sleeve adapted to attach said strap to said actuator end.

7. The apparatus according to claim 6, wherein said sleeve is formed by wrapping said strap around said actuator end and glueing said strap to itself.

8. The apparatus according to claim 4, further comprising:

a stopper device disposed on said main section of the elongated rod between said actuator end and said first connection device.

9. The apparatus according to claim 8, wherein said stopper device comprises a rubber o-ring.

10. The apparatus according to claim 4, further comprising:

a tip disposed at an end of said actuator end of the elongated rod, wherein said tip is adapted to minimize damage to said door.

11. The apparatus according to claim 4, further comprising:

a pullcord attached to said actuator end of said elongated rod, wherein the pullcord is pulled to rotate an opening mechanism in a direction causing said opening mechanism to open said locked door.

12. The apparatus according to claim 4, wherein the main section and curved section together have an overall length greater than the vertical distance between an opening mechanism of the locked door and a floor.

13. The apparatus according to claim 4, wherein said apparatus is operable to open a locked door with one hand.

14. The apparatus according to claim 4, further comprising:

a handle for manipulating and rotating the elongated rod while the elongated rod is under the door, said handle disposed at the handle end of the elongated rod.

15. A tool kit for use by locksmiths to open locked doors, said tool kit comprising:

a first tool comprising (i) an elongated rod adapted for sliding under a bottom of a locked door, said elongated rod comprising a main section, a curved section, a handle end and an actuator end, wherein the handle end, the curved section and the actuator end extend away from the main section in the same direction such that the handle end, the curve section, the main section, and the actuator end define a plane and (ii) a strap adapted for engagement with an opening mechanism, wherein a first end of said strap is attached to said actuator end and a second end of said strap is attached to said main section by a first connection device adapted to slide along said main section of the elongated rod;

a second tool adapted for manipulating the opening mechanism of locked doors having lever type handles;

a third tool adapted for manipulating the opening mechanism of locked doors having panic bar type handles.

16. The tool kit according to claim 15, further comprising:

a fourth tool adapted for manipulating a thumb turn knob of a dead bolt lockset.

17. An apparatus comprising:

an elongated rod adapted for sliding under a bottom of a locked door, said elongated rod comprising a main section, a curved section, a handle end and an actuator end, wherein the handle end, the curved section and the actuator end extend away from the main section in the same direction such that the handle end, the curve section, the main section, and the actuator end define a plane, and wherein the actuator end comprises a first portion, a second portion, a third portion and a fourth portion, the first portion extending substantially perpendicular from the main section and directed in a direction opposite the handle end, the second portion being substantially perpendicular to the first portion, substantially parallel to the main section and directed in a direction opposite the handle end, the third portion being substantially perpendicular to the second portion and directed in a direction toward the handle end and the fourth portion being substantially perpendicular to the third portion and directed in a direction toward the handle end, the fourth portion comprising an end having a wedge shape; and a pullcord attached to said actuator end between said third portion and said fourth portion and passing through a guide attached to said main section near said first portion.

18. A method for pressing a crash bar of a locked door, comprising the steps of:

providing an apparatus comprising an elongated rod and a pullcord, said elongated rod comprising a main section, a curved section, a handle end and an actuator end, wherein the handle end, the curved section and the actuator end extend away from the main section in the same direction such that the handle end, the curve section, the main section, and the actuator end define a plane, wherein the actuator end comprises a first portion, a second portion, a third portion and a fourth portion, the first portion extending substantially perpendicular from the main section and directed in a direction opposite the handle end, the second portion being substantially perpendicular to the first portion, substantially parallel to the main section and directed in a direction opposite the handle end, the third portion being substantially perpendicular to the second portion and directed in a direction toward the handle end and the fourth portion being substantially perpendicular to the third portion and directed in a direction toward the handle end, the fourth portion comprising an end having a wedge shape, and wherein said pullcord is attached to said actuator end near a the wedge shaped end of said actuator end and passes through a guide attached to said main section near said first portion;

sliding the apparatus under a bottom of a locked door;

rotating the apparatus such that the actuator end is substantially vertical to a floor under said locked door;

rotating the apparatus such that the actuator end is raised substantially vertical to the floor under said locked door and in contact with a back of said locked door;

rotating the apparatus such that said wedge end is set between and contacts both a surface of said locked door and a surface of a crash bar opening mechanism of said locked door from above; and pulling the pull cord to press the crash bar of the opening mechanism and open said locked door.

19. The method according to claim 18, wherein the step of manipulating the apparatus comprises moving the handle end toward the hinge edge of the locked door.

* * * * *